US007487804B2

(12) United States Patent
Bruynoghe

(10) Patent No.: US 7,487,804 B2
(45) Date of Patent: Feb. 10, 2009

(54) METHOD FOR WEAVING PILE FABRICS WITH VARIABLE PILE HEIGHT

(75) Inventor: Koen Bruynoghe, De Pinte (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 136 days.

(21) Appl. No.: 11/726,768

(22) Filed: Mar. 23, 2007

(65) Prior Publication Data

US 2007/0235102 A1 Oct. 11, 2007

(30) Foreign Application Priority Data

Apr. 5, 2006 (BE) ..... 2006/0211

(51) Int. Cl.

| | |
|---|---|
| ***D03D 39/08*** | (2006.01) |
| ***D03D 39/02*** | (2006.01) |
| *D03D 39/16* | (2006.01) |
| *D03D 39/00* | (2006.01) |

(52) U.S. Cl. ..... 139/21; 139/7 A; 139/7 R; 139/7 D; 139/7 F; 139/116.5

(58) Field of Classification Search ..... 139/7 A, 139/7 R, 7 D, 7 F, 21, 116.5, 391
See application file for complete search history.

(56) References Cited

U.S. PATENT DOCUMENTS

| | | | | | |
|---|---|---|---|---|---|
| 2,783,776 | A | * | 3/1957 | Lyle | 139/7 A |
| 3,126,919 | A | * | 3/1964 | Matthews et al. | 139/7 B |
| 3,160,176 | A | * | 12/1964 | Carrigan et al. | 139/7 R |
| 3,394,739 | A | * | 7/1968 | Crenshaw et al. | 139/21 |
| 3,963,057 | A | | 6/1976 | Dewhirst | |
| 3,963,058 | A | | 6/1976 | Dewhirst | |
| 3,999,577 | A | * | 12/1976 | Dewhirst | 139/7 R |
| 4,915,138 | A | * | 4/1990 | Derudder | 139/40 |
| 5,076,331 | A | * | 12/1991 | Debaes | 139/291 C |
| 5,123,454 | A | * | 6/1992 | Debaes | 139/54 |
| 5,806,568 | A | * | 9/1998 | Dewispelaere et al. | 139/2 |
| 6,293,314 | B1 | * | 9/2001 | Dewispelaere | 139/2 |
| 6,886,602 | B1 | * | 5/2005 | Debuf et al. | 139/7 R |
| 2004/0108013 | A1 | * | 6/2004 | Debuf et al. | 139/35 |

FOREIGN PATENT DOCUMENTS

| | | |
|---|---|---|
| GB | 1 357 528 | 6/1974 |
| GB | 2 145 121 | 3/1985 |
| GB | 2 411 663 | 7/2005 |

* cited by examiner

*Primary Examiner*—Bobby H Muromoto, Jr.
(74) *Attorney, Agent, or Firm*—James Creighton Wray

(57) ABSTRACT

The present invention relates to a method for weaving pile fabrics having at least two different pile heights in a same pile row in a weaving machine of the gripper-Axminster type, comprising at least two pile yarn carriers (2, 3) separately driven for the selection according to a pattern to be woven, of one or several pile yarns (4) being presented, in a position (5) selected, to a gripper (1) driven by an oscillating gripper shaft, provided to draw the selected pile yarn (4) off the pile yarn carrier (2, 3) throughout a length desired, by rotating the gripper shaft. The said weaving machine furthermore comprises a cutting device (6) to cut through the pile yarn (4) selected after the selection and after which this pile yarn (4) is inserted into the fabric. The present invention likewise relates to pile fabrics manufactured according to such a method and to a gripper-Axminster weaving machine to apply this method.

9 Claims, 3 Drawing Sheets

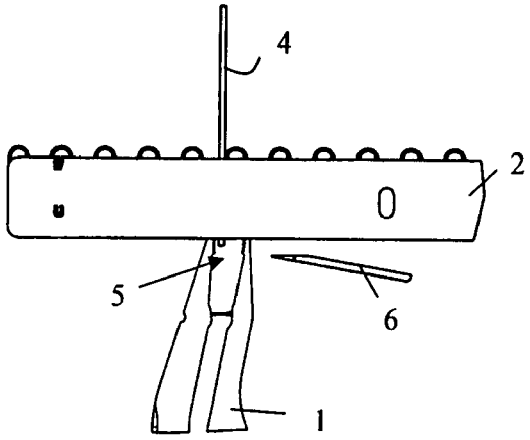
Fig. 1a
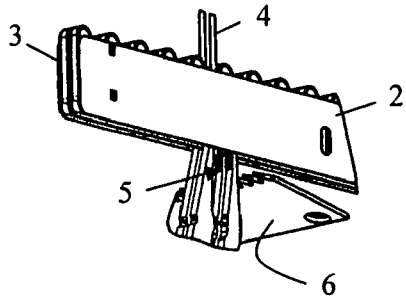
Fig. 1b
Fig. 1
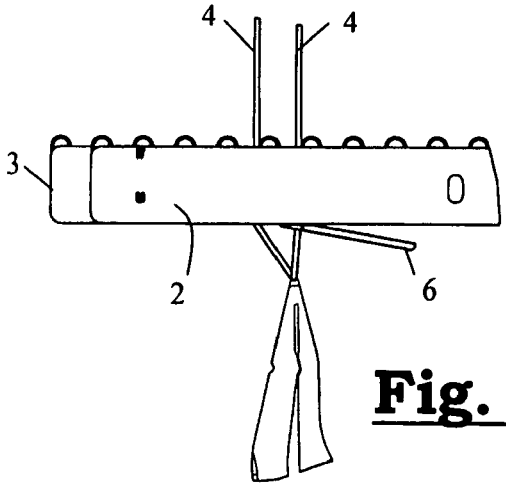
Fig. 2a
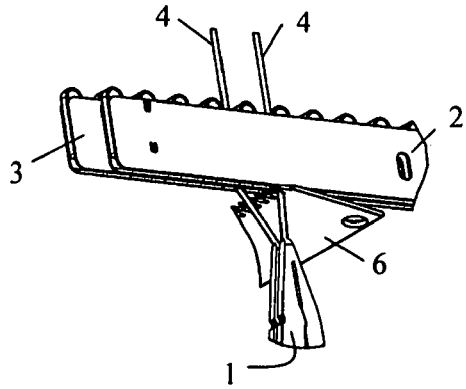
Fig. 2b
Fig. 2

METHOD FOR WEAVING PILE FABRICS WITH VARIABLE PILE HEIGHT

This application claims the benefit of Belgian Application No. 2006/0211 filed Apr. 5, 2006, which is hereby incorporation by reference in its entirety.

BACKGROUND OF THE INVENTION

The present invention relates to a method for weaving pile fabrics having at least two different pile heights in a same pile row in a weaving machine of the gripper-Axminster type, comprising at least two pile yarn carriers separately driven to select, according to a pattern to be woven, of one or several pile yarns being presented, in a position selected, to a gripper driven by an oscillating gripper shaft, provided to draw the selected pile yarn off throughout a length desired, by rotating the gripper shaft, the said weaving machine furthermore comprising a cutting device to cut through the pile yarn selected after the selection and this pile yarn being inserted into the fabric, after the pile warp yarn having been cut. The present invention also relates to pile fabrics made according to such a method on gripper-Axminster weaving machines provided for such a method to be applied.

The pile yarn carriers are provided on a carrier system and are controlled by a Jacquard machine in order to present the pile yarns required, in accordance with the pattern to be woven, to the grippers (which are supported by a gripper shaft). The grippers are clamping the pile yarns selected, after which the device will perform a relative motion between the grippers and the carrier system until the yarns selected will have been drawn off throughout the length required. The cutting device will cut at the level of the pile yarn carriers, so that one part of the pile yarns will remain clamped in the grippers, and the other part of the pile yarns will remain clamped in the pile yarn carriers. The part of the pile yarns picked up by the grippers, will be inserted into the backing fabric by rotating the gripper shaft for weaving it in as a pile.

A strong tendency is observed to realize the pile fabrics having various structures within the same fabric. Not only with face-to-face weaving but also when weaving single fabrics, this tendency to realize various structures in a fabric is known. A variable pile height is one of the aspects for which weaving single fabrics is especially suitable, i.e. one pile in the fabric will have a pile height different from the other pile. In practice, with Axminster weaving this may mean:

- the pile height of the pile in one pile row is different from the pile height in a next pile row (by pile row is meant the total amount of pile yarns which are simultaneously inserted into the fabric by the grippers, installed on a gripper shaft, is used in the fabric);
- the pile height of the pile within one pile row is different from pile to pile;
- the pile height within the fabric will be varying between two or several heights;
- the pile used of a different height, will be all U-tufts or one pile level one pile level is U-tuft and the other pile levels are J-tufts (U-tuft is meaning that the two pile legs of the pile burl, after having been inserted into the fabric, will have the same length; J-tuft is meaning that the two pile legs of the pile burl after having been inserted into the fabric, will have a different length);
- all pile yarns will be suitable for the different pile heights or each pile yarn may only be used for one pile height.

From the state-of-the-art, already different solutions are known to realize different pile heights within one pile row. Thus, the American patent publications U.S. Pat. Nos. 3,963,057 and 3,963,058 are describing a manner in which, in one same pile row, several pile heights are used, by selecting all the pile yarns to be used in one pile row by bringing the pile yarn carriers into their exact position near the grippers. Thereafter, the grippers will take the pile yarns and will move the pile yarn carriers, supporting the pile yarn for which a higher pile height is required, away from the grippers in the direction of the pile yarn cutting device. Then the cutting device will present itself, which is provided with a finger pointing forward throughout the entire length of the cutting device in order to push forward the pile yarns destined to form a longer pile, towards the grippers, so that these pile yarns will be drawn off the carriers throughout a greater length, after which in the pile row, pile yarns may occur having both lengths which will be cut simultaneously by the cutting system.

However, this method has the disadvantage that the fingers provided on the cutting device (which have to draw the pile yarns further off the carrier) are pushing against the yarn at an unfavourable angle. Due to this, the yarn and the carrier will be subjected to an excessively loading. Cutting long pile yarns also will occur at an unfavourable angle, so that the pile height obtained will be inexact and the cut imperfect.

In U.S. Pat. No. 3,963,057 there are two selection elements per pile warp carrier available for that purpose: one to select the pile yarn desired and one to indicate whether the pile yarn in question should be carried out having a longer pile or not. Double the number of selection elements will render the device according to U.S. Pat. No. 3,963,057 very expensive and large.

In U.S. Pat. No. 3,963,058 the shape of the carrier will determine which pile yarn will be selected having a higher pile and which not. This method has the disadvantage that each yarn is destined to form a high pile or a low one, which will strongly restrict the possibilities to form a pattern.

The British patent publication GB 2145121 is likewise describing a device to use pile yarns having a different length within a pile row. Enabling to select, per pile warp carrier (the machine being at rest), which pile yarn may be used for the high pile and which for the low pile, which still means a serious restriction of the possibilities to form patterns. Furthermore, the device is functioning as follows: the pile yarn carriers will present the pile yarns selected to the grippers, which will grip the pile yarns selected. By moving the carrier system, the pile yarns are made to length for the short pile. The pile yarn carriers being adjusted for pile yarns having a short pile, are kept in position, while the pile yarns for the pile yarns destined for the long pile will be brought out of reach of the cutting device. When the cutting device will subsequently proceed to cut, only the pile yarns destined to become short pile are cut through. Subsequently, a cam control will bring the pile yarns to form the long pile back into its position selected, whereupon the pile yarn grippers will realize an additional motion in order to draw the pile yarns off the pile yarn carriers throughout the additional pile length, in order to form the long pile. Then again the cutting knife will carry out a cutting motion. This method has the disadvantage that both the motion of the pile yarn carrier will be controlled by two drives (normal selection and cam control for dividing pile yarns into a short and a long pile) and also the motion to produce pile length (so called draw off) will occur by two drive systems (motion of the carrier system and motion of the gripper).

In the European patent publications EP 1375513 and EP 1375713 an Axminster-Jacquard machine is described, in which each pile yarn carrier is driven by a separate motor to move towards one of the pre-defined positions, the carrier transmitting to the gripper a selected pile yarn or one or several carriers taking up a position to check whether it is positioned correctly.

The purpose of the invention exists in finding a solution to obtain a fabric with several pile heights within a pile row by means of a weaving machine of the gripper-Axminster type, while the pile heights realized within a pile row, may be different from the pile heights realized in other pile rows and where all pile yarns may be used for all pile heights without any restriction. It is a further purpose to attain this by means of a limited number of driving means.

SUMMARY OF THE INVENTION

The purpose of the present invention is attained by providing a method for weaving pile fabrics with at least two different pile heights in a same pile row on a weaving machine of the gripper-Axminster type, comprising at least two pile yarn carriers separately controlled for the selection, in accordance with a pattern to be woven, of one or several pile yarns which, in a selected position, are presented to grippers, driven by an oscillating gripper shaft, which, by rotating the gripper shaft, is provided to draw a desired length of the pile yarn selected off the pile yarn carrier, the said weaving machine further comprising a cutting device to cut through the pile yarn selected after selection, and inserting this pile yarn into the fabric after having cut through the pile yarn. The method according to the invention is characterized in that it is comprising the following steps:

- bringing the one or several pile yarn carriers out of reach of the cutting device by means of their separate drives;
- cutting through, by means of a first cutting motion of the cutting device, the pile yarns selected which are in the pile yarn carriers, which are positioned in the reach of the cutting device in order to obtain pile yarns having a first pile height;
- returning, by means of their separate drives, at least a first part of the pile yarn carriers into their positions in which they will present the pile yarn selected in the position selected;
- performing an additional rotation of the gripper shaft, drawing the pile yarns selected, which are situated in the said first part of the pile yarn carriers, further off these pile yarn carriers;
- cutting through, by means of a second cutting motion of the cutting device, the pile yarns having been drawn off further, in order to obtain pile yarns with a second pile height.

The method according to the invention for weaving pile fabrics having at least two different pile heights in a same pile row has the advantage that:

- each pile yarn may be selected freely, either for a high or for a low pile;
- all motions of the pile yarns are carried out by separate drive motor per pile yarn carrier and for which no additional cams, selection systems or motions of the carrier of the pile yarn carriers are required;
- for all pile yarns the pile length before cutting is determined by a motion of the gripper shaft.

With the method according to the invention, it will be possible to realize more than two pile heights per pile row by, in a preferred embodiment of the method according to the invention, after cutting through the pile yarns drawn off further, in order to obtain pile yarns having a second pile height, returning at least a second part of the pile yarn carriers, by means of their separate drives, to their position in which they will present the pile yarn selected, in the position selected, after which the pile yarns selected, which are presented, in the selected position, by the said second part of the pile yarn carriers, will be drawn off these pile yarn carriers additionally by means of a further rotation of the gripper shaft and next these pile yarns being cut through by means of a third cutting motion of the cutting device in order to obtain pile yarns having a third pile height.

In accordance with a particular method according to the invention, the cutting device is returning to the presentation position after having performed the cutting motion. Due to this, the motion the cutting device has to perform before proceeding to cut and in order to return after cutting, will be restricted. Therefore this will limit the time required to perform these motions, which is important to carry out several cutting cycles during one weaving cycle. The presentation position is the position in which the cutting device is situated before it will proceed to cut.

In a more particular method according to the invention, the cutting device is driven by a servomotor in order to cut through the pile yarns this operation being synchronic with the motions of the weaving machine. Preferably, the servomotor is driven from the controller of the weaving machine.

In a particularly advantageous method according to the invention, the gripper shaft is driven by a servomotor in order to position the grippers in front of the pile yarn carriers, in a manner synchronized with the other motions of the weaving machine, to grip the pile yarns selected and to draw them off the pile yarn carriers in accordance with the length desired and to insert into the fabric the pile yarns cut to length. Preferably, the servomotor is driven from the controller of the weaving machine.

According to another preferred method, during returning of at least a first part of the pile yarn carriers, these pile yarn carriers are synchronized with the gripper shaft. Due to this, the "draw-off" of the additional pile length will already start before the pile yarn carrier will have reached its position. Which means a saving of time and it will be possible to maintain the tension of the pile yarn at a constant value and keep the course of the pile yarn under control.

In accordance with a particular method according to the invention, when moving back at least the first part of the pile yarn carriers, the carriers are moving in a manner synchronized with the cutting device, which is returning to its presentation position.

Preferably, the motors for driving the pile yarn carriers separately may be controlled additionally in order, after a "draw-off" by the gripper shaft, to perform a motion in order to:

- to pull the pile yarns well against the cutting device during the cutting operation;
- to compensate the inclined position of the yarn by the rotating motion of the gripper;
- to relax the tension built up in the pile yarn during the "draw-off".

Another object of the present invention relates to a pile fabric showing at least two different pile heights in a same pile row, the said pile fabric being manufactured in accordance with a method according to the invention as described above.

Yet another object of the present invention relates to a gripper-Axminster weaving machine which is provided to use a method according to the invention as described above.

Now the present invention will be further explained on the basis of the following detailed description of the method for weaving pile fabrics with at least two different pile heights in a same pile row in a weaving machine of the gripper-Axminster type. The only intention of this description is to provide a clarifying example to indicate the further advantages and particulars of the present invention, and by no means may be considered to be a restriction of the field of application of the invention or of its patent rights as demanded for in the claims.

In this detailed description, by means of reference numbers, reference is made to the drawings attached to the present, in which:

BRIEF DESCRIPTION OF THE DRAWINGS

FIG. 1 up to and including

DETAILED DESCRIPTION OF THE PREFERRED EMBODIMENTS

Figure 3:
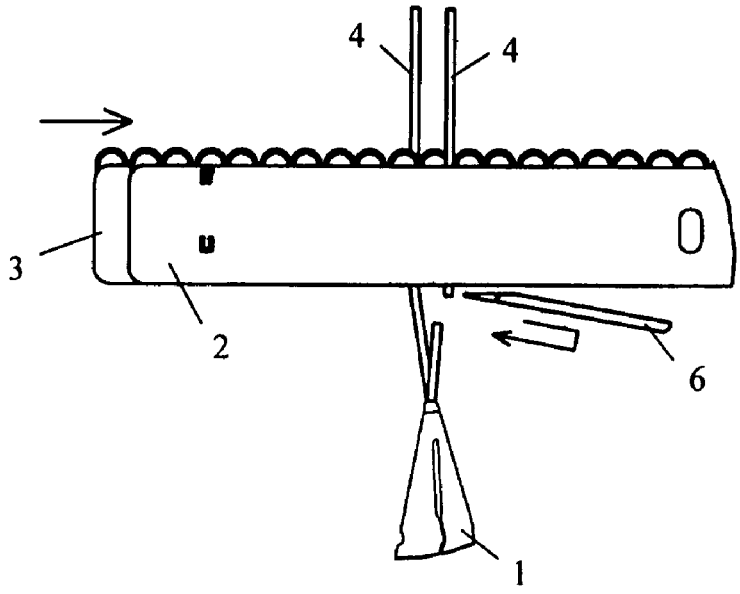

It may be obvious that, in practice, it may be possible that there are more pile yarn carriers and grippers and that normally a pile yarn carrier is containing more than one pile yarn which may be selected in accordance with a pattern to be woven. For the sake of clarity of the drawings, only a restricted number of pile yarns, pile yarn carriers and grippers are represented here.

The present invention relates to a method for weaving pile fabrics having at least two different pile heights in a same pile row on a weaving machine of the gripper-Axminster type. The said weaving machine is provided with a row of grippers (1) which are installed on an oscillating gripper shaft. Furthermore, the weaving machine is provided with at least two individual motor driven pile yarn carriers (2, 3) for the selection (in accordance with a pattern to be woven) of one or several pile yarns (4) which in a selected position (5) are being presented to a gripper (1). By rotating the gripper shaft, the grippers (1) will draw the pile yarn selected (4), throughout the length desired, off the pile yarn carrier (2, 3). In order to cut through the pile yarn selected (4) to the length desired, the weaving machine is additionally provided with a cutting device (6).

The method according to the present invention is characterized in that it comprises the following stages:

- bringing one or several pile yarn carriers (3) out of reach of the cutting device (6) by controlling the separate drives;
- cutting through, by a first cutting motion of the cutting device (6), the pile yarns (4) selected which are situated in the pile yarn carriers (2) which are positioned within reach of the cutting device (6) in order to obtain pile yarns having a first pile height;
- returning at least a first part of the pile yarn carriers (3) to their position in which they are presenting the pile yarns selected in the position (5) selected, by controlling their separate motors;
- performing an additional rotation of the gripper shaft, the pile yarns selected, situated in the said first part of the pile yarn carriers (3), being drawn further off these pile yarn carrier;
- cutting through, with a second cutting motion of the cutting device (6), the pile yarns having been drawn off further, in order to obtain pile yarns having a second pile height.

After this, the gripper shaft is moving on further towards the fabric, in order to position the grippers (1) below the fell of the fabric, after which a weft is inserted into the fabric and the gripper shaft is moving back the grippers (1) and will open them at a height desired in order to release the tuft to be presented again to the Jacquard machine in order to take the next pile yarn (4), selected by the Jacquard machine, from the pile yarn carriers (2, 3).

In accordance with the method according to the present invention, it will become possible to realize a third pile height within the same pile row. Namely, after having cut through the pile yarns drawn off further, in order to obtain pile yarns having a second pile height, having at least a second part of the pile yarn carriers (3) move back again to their position in which they present the pile yarn selected in the position selected. And then, by drawing off additionally the pile yarns selected, situated in the said second part by a further rotation of the gripper shaft and subsequently cutting them through by means of a third cutting motion of the cutting device, pile yarns having a third pile height are obtained.

The cutting device (6) will remain in a presentation position, between the two cutting motions (or several, if a third pile height will be realized). This will restrict the motion necessary to be performed in order to proceed to the cutting operation and to return. This means a saving of time, which is important to be able to perform several cutting cycles during one weaving cycle.

It is possible to multiply the number of cutting bits on the cutting device (6) to obtain a multiple which will be equal to the number of different pile heights, so that the cutting device (6), at each cutting motion during the cycle will be moving further on in the same direction, which will produce a further saving of time and may enable more cutting cycles to be performed during one weaving cycle. A cutting bit is an exchangeable cutting element which is installed on the cutting device. Normally, several cutting bits are regularly distributed across the width of the weaving machine. The distance between two cutting bits will determine the distance the cutting device has to move in order to cut through all the pile yarns.

The number of cutting bits may remain the same, the cutting device (6) moving in one direction for cutting through the pile yarns (4) with the first pile height, whereas for cutting through the pile yarns (4) with the second pile height, the cutting device (6) will be moving in the opposite direction.

The principle of the method according to the invention is represented in the FIGS. 1 up to and including 5, the FIGS. 1*a* and 1*b* being a representation of two pile yarn carriers (2, 3) each having selected a pile yarn (4) (in accordance with the pattern to be woven) and which are presenting the pile yarn (4) selected to a gripper (1) in a pre-defined position (5).

After the grippers having gripped the pile yarn (4) selected a pile yarn carrier (3) selected will be brought out of reach of the cutting device (6) and the pile warp yarn (4), provided in the non-selected pile yarn carrier (2) (i.e. the pile yarn carrier remaining in its position) will be drawn off the non-selected pile yarn carrier, throughout a first tuft length, by rotating the gripper shaft. (see FIGS. 2*a* and 2*b*)

Subsequently, as represented in FIG. 3, the pile yarn (4) which is situated in the non-selected pile yarn carrier (2) will be cut through by means of a first cutting motion of the cutting device (6). After this pile yarn (4) has been cut through, the cutting device (6) will return into its presentation position, ready to perform a next cutting motion.

Figure 4:
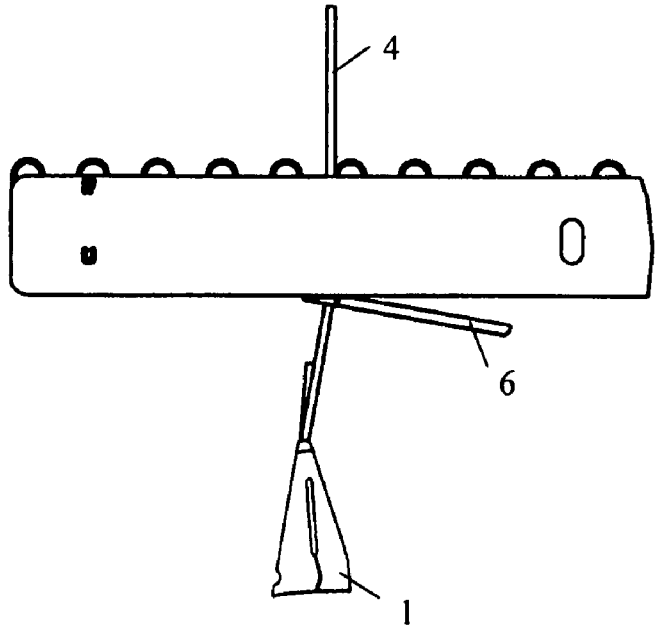

After the pile yarn (4) of the non-selected pile yarn carrier (2) has been cut through, the pile yarn carrier (3) selected will return back into its original position (see FIG. 4), in which the pile yarn selected (4) will be brought into the position (5) selected. Because of an additional rotation of the gripper shaft the pile yarn (4) selected in the pile yarn carrier (3) selected will be drawn off by the gripper (1) throughout a second tuft length. The cutting device (6) will cut through this pile yarn (4) drawn off throughout a second tuft length.

Figure 5:
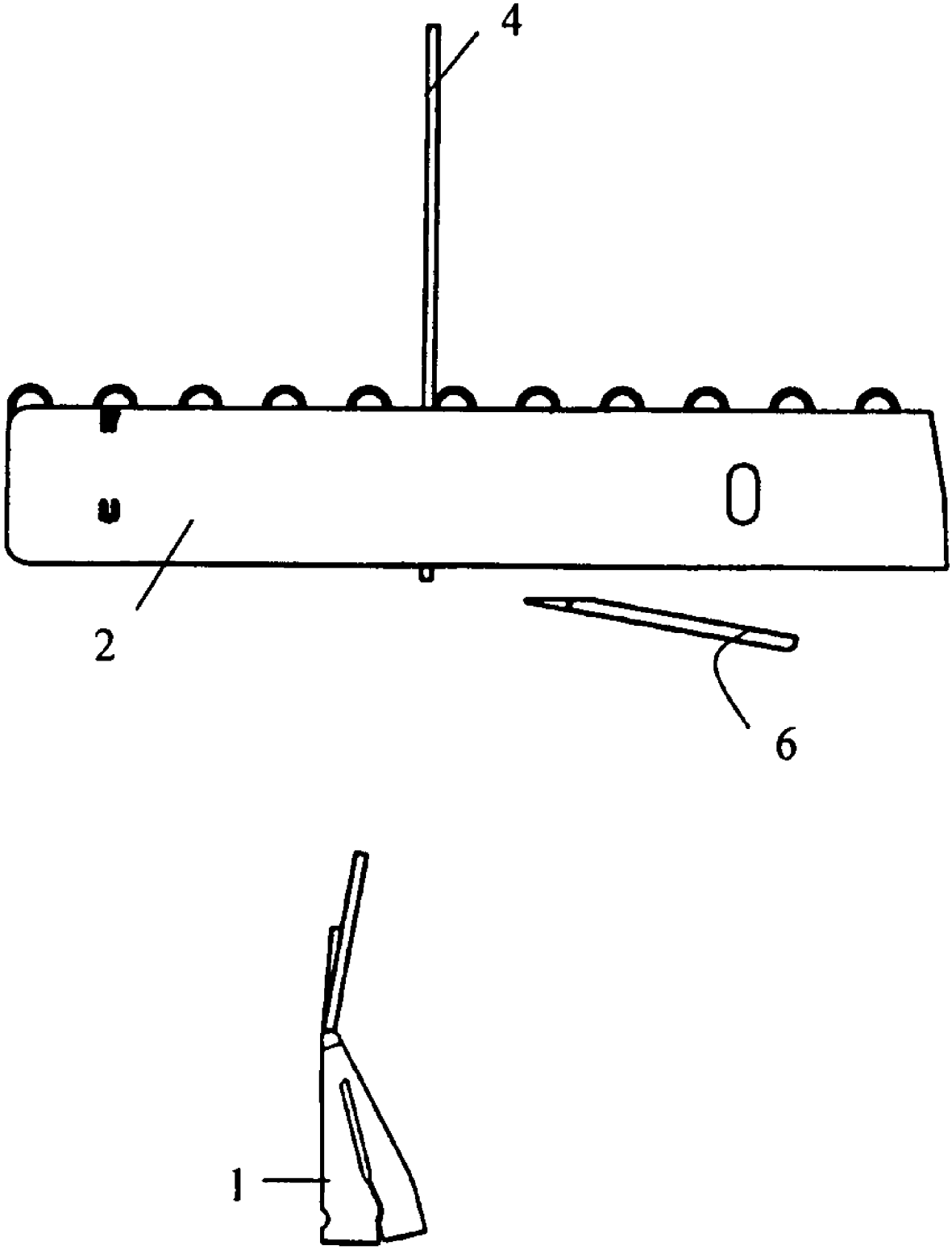
FIG. 5 is representing a number of positions of two pile yarn carriers with selected pile yarns, grippers and a cutting system in order to clarify the method according to the present invention.

Finally, the cutting device (6), as represented in FIG. 5, will withdraw entirely and the grippers (1) will (because of the further oscillation of the gripper shaft) bring the pile yarns below the fabric fell, after which a weft will be inserted and the grippers (1) will be brought back towards the pile yarn carriers (2, 3) and in the moment, corresponding with the pile length desired of the pile in the fabric, the pile yarn will be released.

The invention claimed is:

1. Method for weaving pile fabrics having at least two different pile heights in a same pile row on a weaving machine of the gripper-Axminster type, comprising at least two pile yarn carriers (2, 3) separately controlled for the selection, according to a pattern to be woven, of one or several pile yarns (4) being presented, in a position selected, to a gripper (1) driven by an oscillating gripper shaft, provided to draw the selected pile yarn (4) off the pile yarn carrier (2, 3), throughout a length desired, by rotating the gripper shaft, the said weaving machine furthermore comprising a cutting device (6) to cut through the pile yarns (4) selected after the selection, and this pile yarn (4) being inserted into the fabric, after the pile warp yarn (4) having been cut through, characterized in that the method is comprising the following stages:

bringing the one or several pile yarn carriers (3) out of reach of the cutting device (6) by means of their separate drives;

cutting through, by means of a first cutting motion of the cutting device (6) , the pile yarns (4) selected which are in the pile yarn carriers (2), which are positioned in the reach of the cutting device (6) in order to obtain pile yarns having a first pile height;

returning, by means of their separate drives, at least a first part of the pile yarn carriers (3) into their positions in which they will present the pile yarn selected in the position (5) selected;

performing an additional rotation of the gripper shaft, drawing the pile yarns selected, which are situated in the in the said first part of the pile yarn carriers (3), further off these pile yarn carriers;

cutting through, by means of a second cutting motion of the cutting device (6), the pile yarns having been drawn off further, in order to obtain pile yarns with a second pile height.

2. Method according to claim 1, characterized in that, after the pile yarns drawn off further, in order to obtain pile yarns having a second pile height, at least a second part of the pile yarn carriers, by means of their separate drives, are returning to their positions in which they will present the pile yarn selected, in the position selected (5), after which the pile yarns selected, which are presented, in the said second position, by the second part of the pile yarn carriers, will be drawn off these pile yarn carriers additionally by means of a further rotation of the gripper shaft and next these pile yarns will be cut through by means of a third cutting motion of the cutting device (6) in order to obtain pile yarns having a third pile height.

3. Method according to claim 1, characterized in that the cutting device (6), after having performed a cutting motion, will return to the presentation position.

4. Method according to claim 1, characterized in that the cutting device (6) will be driven by a servomotor in order to cut through the pile yarns in a manner synchronic with the other motions of the weaving machine.

5. Method according to claim 1, characterized in that the gripper shaft (1) is driven by a servomotor in order to, in a manner synchronized with the other motions of the weaving machine, position the grippers (1) for the pile yarn carriers (2, 3), to grip the pile yarns (4) selected and to draw off the pile yarn carriers (2, 3) according to the length desired and to insert the pile yarns cut off into the fabric.

6. Method according to any claim 1, characterized in that, when returning at least a first part of the pile yarn carriers (3), these pile yarn carriers will be moving in a manner synchronized with the gripper shaft.

7. Method according to claim 3, characterized in that, when bringing back at least a first part of the pile yarn carriers (3) , these pile yarn carriers will be moving in a manner synchronized with the cutting device (6) returning to its presentation position.

8. Pile fabric having at least two different pile heights in a same row, characterized in that the said pile fabric will be manufactured according to claim 1.

9. Gripper-Axminster weaving machine, characterized in that the gripper-Axminster weaving machine is equipped to apply a method according claim 1.

* * * * *